US009260783B2

(12) United States Patent
Dunleavy et al.

(10) Patent No.: US 9,260,783 B2
(45) Date of Patent: Feb. 16, 2016

(54) ELECTROLESS METAL DEPOSITION FOR MICRON SCALE STRUCTURES

(75) Inventors: Michael Dunleavy, Bristol (GB); Sajad Haq, Glasgow (GB); Martyn John Hucker, Woolaston (GB)

(73) Assignee: BAE SYSTEMS PLC, London (GB)

( * ) Notice: Subject to any disclaimer, the term of this patent is extended or adjusted under 35 U.S.C. 154(b) by 429 days.

(21) Appl. No.: 13/203,622

(22) PCT Filed: Feb. 25, 2010

(86) PCT No.: PCT/GB2010/050317

§ 371 (c)(1), (2), (4) Date: Aug. 26, 2011

(87) PCT Pub. No.: WO2010/097620

PCT Pub. Date: Sep. 2, 2010

(65) Prior Publication Data

US 2011/0305825 A1 Dec. 15, 2011

(30) Foreign Application Priority Data

Feb. 27, 2009 (GB) ..... 0903642.7

(51) Int. Cl.
*C23C 18/16* (2006.01)
*C23C 18/44* (2006.01)

(52) U.S. Cl.
CPC ..... *C23C 18/44* (2013.01); *C23C 18/1616* (2013.01); *C23C 18/1678* (2013.01)

(58) Field of Classification Search
CPC ..... C23C 18/1616
USPC ..... 427/238
See application file for complete search history.

(56) References Cited

U.S. PATENT DOCUMENTS

| | | | | |
|---|---|---|---|---|
| 4,695,489 | A | 9/1987 | Zarnoch et al. | |
| 4,904,633 | A * | 2/1990 | Ohata et al. | 502/304 |
| 5,130,168 | A | 7/1992 | Mathe et al. | |
| 5,470,381 | A * | 11/1995 | Kato et al. | 106/1.23 |
| 6,224,983 | B1 | 5/2001 | Sodervall et al. | |

(Continued)

FOREIGN PATENT DOCUMENTS

| | | |
|---|---|---|
| GB | 1 143 883 A | 2/1969 |
| GB | 0812483.6 | 7/2008 |

(Continued)

OTHER PUBLICATIONS

Notification Concerning Transmittal of International Preliminary Report on Patentability (Forms PCT/IB/326 and PCT/IB/373) and the Written Opinion of the International Searching Authority (Form PCT/ISA/237) issued on Sep. 9, 2011, in the corresponding International Application No. PCT/GB2010/050317.

(Continued)

*Primary Examiner* — Alex A Rolland
(74) *Attorney, Agent, or Firm* — Maine Cernota & Rardin

(57) ABSTRACT

A method for electroless metal deposition on a surface in a finely dimensioned space (e.g. the bore of a hollow fiber) includes introducing into the space an electroless plating solution that has a nil or relatively low plating rate at normal room temperature, and thereafter heating the structure to an elevated temperature for a period sufficient to cause metal to plate on the wall surface. The introducing and heating may be repeated as necessary or desired to build up a specified thickness.

22 Claims, 1 Drawing Sheet

(56) References Cited

U.S. PATENT DOCUMENTS

| | | | | |
|---|---|---|---|---|
| 6,361,824 | B1 | 3/2002 | Yekimov et al. | |
| 6,761,929 | B2 * | 7/2004 | Damle | 427/238 |
| 2002/0064592 | A1 | 5/2002 | Datta et al. | |
| 2005/0006339 | A1 | 1/2005 | Mardilovich et al. | |
| 2005/0127332 | A1 * | 6/2005 | Nakagawa et al. | 252/500 |
| 2006/0121200 | A1 * | 6/2006 | Halpert et al. | 427/305 |
| 2008/0237919 | A1 | 10/2008 | Liu et al. | |
| 2009/0047188 | A1 * | 2/2009 | Miyairi et al. | 422/180 |

FOREIGN PATENT DOCUMENTS

| | | | |
|---|---|---|---|
| GB | 0812486.9 | | 7/2008 |
| JP | 2-043373 | A | 2/1990 |
| WO | WO 2010/004313 | A1 | 1/2010 |
| WO | WO 2010/004323 | A1 | 1/2010 |

OTHER PUBLICATIONS

International Search Report (PCT/ISA/210) issued on Jul. 14, 2010, by Japanese Patent Office as the International Searching Authority for International Application No. PCT/GB2010/050317.

Written Opinion (PCT/ISA/237) issued on Jul. 14, 2010, by Japanese Patent Office as the International Searching Authority for International Application No. PCT/GB2010/050317.

United Kingdom Search Report, issued on Jul. 29, 2009, for Application No. GB0903642.7.

Lobuyuki Takeyasu et al., "Metal Deposition Deep into Microstructure by Electroless Plating," Japanese Journal of Applied Physics, 2005, pp. L1134-L1137, vol. 44, No. 35.

* cited by examiner

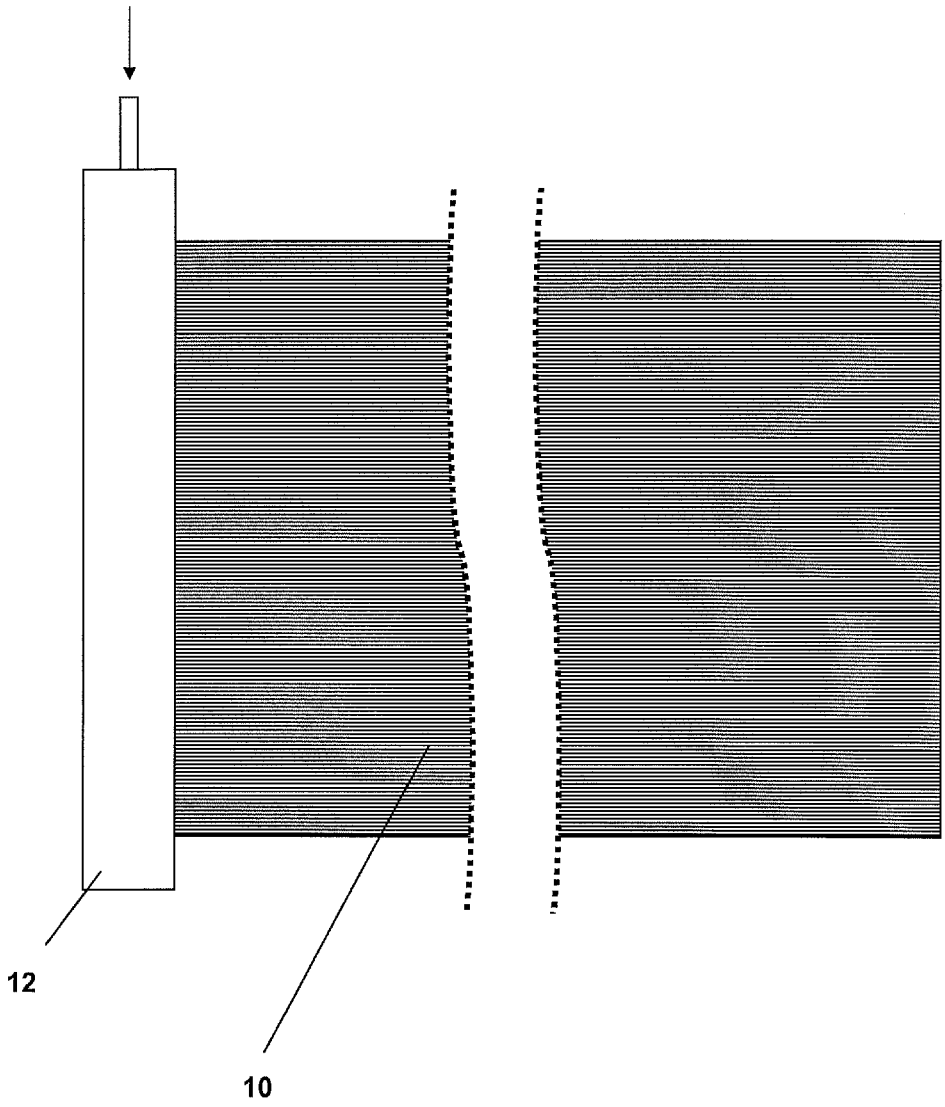
12
10

ELECTROLESS METAL DEPOSITION FOR MICRON SCALE STRUCTURES

This invention relates to electroless metal deposition for micron scale structures and in particular, but not exclusively, to metal plating of finely dimensioned spaces such as the internal surfaces of a hollow fibre, or the interstitial spaces between fibres in a collection thereof.

There are numerous applications in nano-engineering and elsewhere where it is necessary to plate the wall surfaces in fine passages. in a structure. In our earlier UK patent applications Nos. 0812483.6 and 0812486.9, we describe arrangements where a fibre reinforced composite structure is produced in which the fibres are hollow and serve the purpose both as reinforcement fibres for the composite but also as electric circuit elements, whether simply as conductors or as active circuit elements such as capacitors, electric cells etc. For such applications it is important to be able reliably to deposit metal along the length of the bore of a hollow fibre. The fibre may be many meters long and plating consistently along the length is an extremely difficult task.

Takeyasu et al. [Takeyasu N, Tanaka T and Kawata S, "Metal deposition into deep microstructure by electroless plating", Japanese Journal of Applied Physics, 44, NO. 35, 2005, pp. 1134-1137.]describe a process in which Gold is deposited on the inner wall of a capillary tube with an internal diameter of 50 μm by initially treating the glass surface with a sensitiser ($SnCl_2$) and then dipping in a mixed solution of an aqueous solution made up of HAuCl4 and NaCl) and glycerol to allow natural filling of the tube.

We have used this process experimentally to plate the bores of hollow fibres. We have found that, particularly with fine dimensions to the plated, the process does not work satisfactorily because the end through which the plating solution is introduced plates up quickly so that the bores clog within a few minutes due to the build up of metal. This blocks passage of the fluid along the ball and so the plating is confined to the end region.

There is therefore a need for a plating process which can be used to deposit metal at the required thickness along extended lengths of a bore such that a more or less consistent plated layer is obtained. We have considered the thermodynamics and kinetic effects and developed a process which does not suffer from clogging, and so allows plating along an extended bore. We have therefore developed a process in which a metal plating solution is substantially non-reactive or reacts very slowly at normal room temperature but which can be activated or accelerated by exposure to an elevated temperature. Our detailed assessment is that certain applications, such as the provision of an electrically conducting core in a hollow elongate fibre, the adhesion on the metal to the underlying substrate is not as critical as in other conventional applications where the adhesion strength is very important. Therefore plating processes that otherwise would be dismissed as being impractical for conventional plating processes for poor adhesion strength may be particularly well suited to deposition of metal in narrow spaces, where the primary objective is to provide a current path.

Accordingly, in one aspect, this invention provides a method of depositing metal on at least part of the wall surface in a passage in a structure, which comprises the steps of:

introducing into said passage an electroless plating solution comprising a mixture of a metal source or compound and a reducing agent, the metal source or compound having a nil or relatively low plating rate at normal room temperature;

heating said structure to an elevated temperature for a period sufficient to cause a metal layer to form on said wall surface, and optionally repeating said introducing and heating steps.

Preferably said metal source or compound is a metal salt.

Preferably said structure is heated to at least 50° C.

The passage may be the bore of a hollow fibre element or any other finely dimensioned passage or detail such as an interstitial passage defined between two or more closely spaced elongate elements. The term passage is used to mean any space into which a liquid may be passed; it includes both high and low aspect recesses (blind passages) or vias. The passage preferably has a cross-sectional area less than $2\times10^{-11}$ $m^2$.

Although there will be instances where just a single passage is to be plated, in many applications the structure may comprise a plurality of passages extending in the same general direction, and so said method preferably includes plating said a plurality of passages substantially simultaneously.

Advantageously said electroless plating solution is introduced into said passage by the application of a pressure differential. The pressure differential may be applied by applying elevated pressure to pass the electroless plating solution along said passage. The elevated pressure may be applied by exposing said solution to fluid pressure, for example a relative inert, non-oxidising gas such as pressurised nitrogen. The pressure is preferably at least 2 bar, although this depends on the length and other dimensions of the passage.

More preferably said structure is heated to a temperature of between 80° C. and 90° C. for a period of at least 15 minutes.

Preferably the metal plating is deposited to a thickness of at least 100 nm.

Preferably said electroless plating solution is introduced into a passage not previously sensitised.

The electroless plating solution may be aqueous or non-aqueous.

Preferably said electroless plating solution is a gold plating solution.

Preferably said electroless gold plating solution comprises a metal salt formed by mixing chloroauric acid and a base.

Preferably said base comprises sodium hydroxide.

Preferably said reducing agent is a weak a reducing agent.

Preferably said reducing agent comprises ethanol or an aqueous solution thereof.

In another aspect this invention provides an electroless plating reagent comprising a mixture of a gold salt and a weak reducing agent.

Preferably said gold salt is formed by mixing chloroauric acid and a base.

Whilst the invention has been described above it extends to any inventive combination of the features set out above or in the following example.

For a better understanding of the invention an example thereof will now be given, reference being made to the accompanying FIG. 1 which is a schematic view of fibre composite panel with a manifold for introducing and withdrawing an electroless plating solution.

EXAMPLE 1

The following solutions are made up. A stock gold salt solution is made by diluting 1 g of chloroauric acid (HAuCl4) in 10 ml of de-ionised (DI) water. A plating solution is then made up by mixing 1.0 ml stock gold salt solution prepared as above with 30 mg NaCl (common salt) and 180 mg NaOH (sodium hydroxide). These quantities may be scaled in proportion to provide larger quantities. The solution is stable (no plating visible) for at least 5-6 hours at room temperature.

A stock reducing agent is made up by mixing 5 ml ethanol in 100 ml DI water to provide 5% vol. ethanol in DI water mixture.

A fibre reinforced panel 10 is assembled from a number of mats of 0°/90° weave of hollow glass fibres of 10 μm nominal outer diameter and of 5-7 μm nominal internal diameter. The ends of the 0° fibres are connected to a common manifold 12 in flow communication with the fibres. Further details of such manifold designs and methods are disclosed in more detail in our copending UK patent application number 0724683.8.

When ready to plate, equal quantities of plating solution and reducing agent are mixed, introduced into the manifold and injected into the panel using 2-4 bar pressure dry nitrogen. When the panel is filled it is transferred to an oven at 80-90° C. for 20 minutes to plate out the gold. The spent mixture is then expelled from the panel under gas pressure. Visual inspection and electrical measurement confirmed the presence of a metal film on the inner surface of the fibre (the colour of the panel changed form light to dark and the fibres were electrically conductive). If required the panel may be cooled and refilled with a fresh mixture to build up a thicker layer.

In this way, we have provided an effective metal deposition method which can be used to introduce a liquid plating mixture into extended lengths of fine bore fibres without significant plating occurring that might otherwise clog or block the fibre bore. Then, once the required length has been filled with the liquid plating mixture, the plating process can be activated by heat to deposit metal. Although in the above example hollow fibres are plated, it will be appreciated that this same technique may be employed for plating other micron scale features such as vias and other small recesses and spaces.

What is claimed is:

1. A method of depositing metal on at least part of an inner wall surface of a hollow fiber defining a passage in a structure that includes a plurality of such fibers and passages extending in a same general direction, comprising:

introducing into and retaining in said plurality of passages substantially simultaneously an electroless plating solution including a mixture of a metal source or compound and a reducing agent at a first temperature, wherein said plating solution is relatively inactive at said first temperature and relatively active above a second, elevated, temperature;

allowing said solution to substantially cease flowing within said passages;

thereafter heating said structure to at least said second, elevated, temperature while the plating solution is retained in the passage for a period sufficient to cause a metal layer to form on said wall surface; and after the heating of said structure, expelling a spent mixture of the metal source or compound and the reducing agent from the passages by gas pressure.

2. A method according to claim 1, wherein said metal source or compound comprises a metal salt.

3. A method according to claim 1, wherein said structure is heated to at least 50° C. to cause said metal layer to form.

4. A method according to claim 1, wherein said first temperature is normal room temperature.

5. A method according to claim 1, further comprising introducing into and retaining the electroless plating solution in an interstitial passage defined between two or more closely spaced passages of the structure.

6. A method according to claim 1, wherein said electroless plating solution is introduced into said passages by application of a pressure differential along and internal to said passages, wherein said pressure differential biases the electroless plating solution through said passages.

7. A method according to claim 6, wherein said pressure differential is applied by applying elevated pressure to pass the electroless plating solution along said passages.

8. A method according to claim 7, wherein said elevated pressure is applied by exposing said solution to a pressurised fluid.

9. A method according to claim 8, wherein said pressurised fluid is pressurised nitrogen.

10. A method according to claim 9, wherein said pressure is at least 2 bar.

11. A method according to claim 1, wherein said structure is heated to a temperature of between 80° C. and 90° C. for a period of at least 15 minutes.

12. A method according to claim 1, wherein the metal is deposited to a thickness of at least 100 nm.

13. A method according to claim 1, wherein said plating solution is introduced into a passage not previously sensitized.

14. A method according to claim 1, wherein said electroless plating solution is a gold plating solution.

15. A method according to claim 14, wherein said electroless gold plating solution is formed by mixing chloroauric acid and a base.

16. A method according to claim 15, wherein said base comprises sodium hydroxide.

17. A method according to claim 1, wherein said reducing agent is a weak reducing agent.

18. A method according to claim 17, wherein said reducing agent comprises ethanol.

19. A method according to claim 1, comprising:

repeating of said introducing and heating steps.

20. A method according to claim 1, wherein a passage of the plurality of passages has a cross-sectional area less than $2\times10^{-11}$ $m^2$.

21. A method according to claim 1, wherein the plurality of passages are mats of 0°/90° weave of hollow glass fibers of 10 μm nominal outer diameter and of 5-7 μm nominal internal diameter.

22. A method according to claim 21, wherein ends of the 0° fibers are connected to a common manifold in flow communication with the fibers.

* * * * *